US011420781B2

(12) United States Patent
Sauerwein et al.

(10) Patent No.: US 11,420,781 B2
(45) Date of Patent: Aug. 23, 2022

(54) PACKAGING DEVICE AND PACKAGING PROCESS

(71) Applicant: AUTEFA SOLUTIONS GERMANY GMBH, Friedberg (DE)

(72) Inventors: Norbert Sauerwein, Augsburg (DE); Dirk Falise, Kaufering (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 200 days.

(21) Appl. No.: 16/631,497

(22) PCT Filed: Jul. 11, 2018

(86) PCT No.: PCT/EP2018/068741
§ 371 (c)(1),
(2) Date: Jan. 16, 2020

(87) PCT Pub. No.: WO2019/016040
PCT Pub. Date: Jan. 24, 2019

(65) Prior Publication Data

US 2020/0172275 A1 Jun. 4, 2020

(30) Foreign Application Priority Data

Jul. 18, 2017 (DE) ..... 10 2017 116 164.3

(51) Int. Cl.
*B65B 27/12* (2006.01)
*B65B 9/13* (2006.01)
(Continued)

(52) U.S. Cl.
CPC ..... *B65B 27/125* (2013.01); *B65B 9/13* (2013.01); *B65B 11/02* (2013.01); *B65B 41/04* (2013.01)

(58) Field of Classification Search
CPC ..... B65B 27/12; B65B 27/125; B65B 9/13; B65B 9/14; B65B 11/02; B65B 11/025;
(Continued)

(56) References Cited

U.S. PATENT DOCUMENTS 3,589,100 A * 6/1971 Konars ..... B65B 9/026 53/526
3,994,116 A * 11/1976 McCormick ..... B65B 9/026 53/418
(Continued)

FOREIGN PATENT DOCUMENTS

CN 101318568 A 12/2008
CN 103889841 A 6/2014
(Continued)

*Primary Examiner* — Joshua G Kotis
(74) *Attorney, Agent, or Firm* — McGlew and Tuttle, P.C.

(57) ABSTRACT

A method and a baling system includes at least one baler (14) for producing highly compressed bales (2) made of artificial fibers. The baler (14) includes a securing device for applying a securing device (3), in particular strapping, to the compressed bales (2). A packaging device (1) applies a bale casing (4) that is closed on all sides to the secured compressed bales (2). The packaging device (1) includes a production and application device (21) for producing a sleeve-type casing (5) and for the application thereof to the compressed bales (2), as well as a sealing device (22) for closing and sealing axial ends (6, 7) of the sleeve-type casing (5) on the uncovered sides of the bales.

8 Claims, 8 Drawing Sheets

(51) Int. Cl.
*B65B 11/02* (2006.01)
*B65B 41/04* (2006.01)

(58) Field of Classification Search
CPC ... B65B 41/04; B65B 43/465; B65B 67/1277; A01F 15/071; A01F 15/0715; A01F 2025/142; A01F 2025/145
See application file for complete search history.

(56) References Cited

U.S. PATENT DOCUMENTS

| | | | | | |
|---|---|---|---|---|---|
| 4,495,751 | A * | 1/1985 | Galbiati | B65B 9/13 | 53/576 |
| 9,038,355 | B2 * | 5/2015 | Honegger | B65B 59/001 | 53/492 |
| 2004/0237810 | A1 * | 12/2004 | de Baat | B30B 9/30 | 100/218 |
| 2006/0053750 | A1 * | 3/2006 | Petersen | B65B 9/14 | 53/441 |
| 2011/0011036 | A1 | 1/2011 | Falise et al. | | |
| 2012/0186197 | A1 * | 7/2012 | Potempa | B65B 27/125 | 53/452 |
| 2013/0291485 | A1 * | 11/2013 | McCorkle | B65B 25/02 | 53/384.1 |
| 2014/0041339 | A1 * | 2/2014 | Borrelli | B65B 27/125 | 53/438 |
| 2014/0360139 | A1 * | 12/2014 | Honegger | B65B 39/06 | 53/492 |

FOREIGN PATENT DOCUMENTS

| | | | | |
|---|---|---|---|---|
| CN | 105050900 | A | 11/2015 | |
| CN | 204822164 | U | 12/2015 | |
| DE | 3432832 | A1 | 3/1986 | |
| DE | 4015642 | A1 | 11/1991 | |
| DE | 202011051610 | U1 | 12/2012 | |
| DE | 102017119296 | A1 * | 2/2019 | B65B 5/022 |
| EP | 1120237 | A2 | 8/2001 | |
| EP | 1770014 | A2 * | 4/2007 | B65B 11/12 |
| WO | 8809748 | A1 | 12/1988 | |
| WO | 9727008 | A1 | 7/1997 | |
| WO | 2009115314 | A1 | 9/2009 | |
| WO | 2012099754 | A2 | 7/2012 | |

* cited by examiner

PACKAGING DEVICE AND PACKAGING PROCESS

CROSS REFERENCE TO RELATED APPLICATIONS

This application is a United States National Phase Application of International Application PCT/EP2018/068741, filed Jul. 11, 2018, and claims the benefit of priority under 35 U.S.C. § 119 of German Application 10 2017 116 164.3, filed Jul. 18, 2017, the entire contents of which are incorporated herein by reference.

TECHNICAL FIELD

The present invention pertains to a packaging device with at least one baling press for producing highly compacted pressed bales of fibers, especially synthetic fibers, with a fixing device for applying a fixing element, especially a tightening strap, on the pressed bale and with a packaging device for placing a bale wrapper closed on all sides on the fixed pressed bale, and to a packaging process producing packaged pressed bales of fibers, especially synthetic fibers, wherein each pressed bale is produced and compacted in a baling press between pressure rams under very high pressure. and the highly compacted pressed bale is provided with a fixing device and is packaged in a bale wrapper closed on all sides.

TECHNICAL BACKGROUND

It is known from WO 88/09748 A1 and DE 40 15 642 A1 that a pressed bale consisting of fibers, especially synthetic fibers, can be packaged within a baling press in an all-around bale wrapper and can be fixed by tightening straps. The multipart bale wrapper comprises a bottom film and a cover film, which are thrown and placed around the bale. In addition, a body belt may be put on. This bale wrapper is located under the tightening strap. The bale wrapper and the tightening strap are placed at a time at which the pressed bale is still being clamped by the pressure rams, which are under a very high pressure of, e.g., several hundred tons. Such pressed bales have a very high compaction and tend to expand after they are released. The bale wrapper and the fixing device must be correspondingly stable.

WO 2009/115314 A1 shows a packaging of already strapped pressed bales in a partially open bale wrapper, which is formed by a stretch hood. A bale wrapper closed on all sides can be formed by applying two stretch hoods to opposite sides of the bale while turning the pressed bale in the meantime.

SUMMARY

An object of the present invention is to provide an improved packaging technology.

The packaging technology disclosed, i.e., the packaging process and the packaging device used for this purpose, as well as the other aspects of the present invention have various advantages.

The highly compacted pressed bale consisting of fibers, especially synthetic fibers, which is provided with a fixing device, is packaged in a bale wrapper, which is closed on all sides, the pressed bale being provided with a tube-like (tube-shape) envelope. The axial ends of this envelope are brought closer to the uncovered sides of the bale and are closed with a closure, especially a weld seam. This packaging operation can be carried out very rapidly and precisely and requires only a small place for installation and a low effort in terms of control engineering. The packaging technology has a high performance capacity. It can package 60 pressed bales or more per hour. In addition, the packaging technology is especially economical in terms of the design effort and the amount of materials used for the bale wrapper. The packaging technology is flexible and makes adaptation possible to different bale formats, which may vary within a broad range, in a short time. The packaging technology may be used in a baling press plant in which a mix of different bale formats is produced and packaged.

The packaging technology being claimed makes it possible to use a one-piece bale wrapper. This saves material and avoids waste.

In addition, it is possible to apply the tube-shape envelope to the pressed bale during the conveying of the latter. The preferably linear conveying motion can be used to pull the tube-shape envelope over the pressed bale. The energy necessary for pulling over can be applied by the conveying motion. On the other hand, it is also possible to provide the unmoving pressed bale with a tube-shape envelope and with a bale wrapper, which is closed on all sides. The pressed bale may be conveyed continuously or intermittently.

The tube-shape envelope can be placed on the pressed bale, and the axial ends of the envelope can be brought closer and closed in different ways. The sequence of these packaging steps is also variable. The bringing closer and closing of the axial ends of the tube-shape envelope may be carried out before and/or after the pressed bale is received in the tube-shape envelope. In one embodiment, one axial end may be closed before the tube-shape envelope is placed on the pressed bale, as a result of which the envelope assumes a bag-like shape. It now has a bottom and an opening at the axial ends. The tube- or bag-like envelope can be widened and can be pulled over the moving pressed bale. The other, open, axial end of the envelope can be brought closer and closed with a time delay after the pressed bale has been received in the above-described manner.

In one embodiment, the pressed bale can be inserted into the widened opening of the stretched or shortened tube- and bag-like envelope. In case of a stretched envelope shape, the pressed bale is pushed in up to the closed axial end or bottom. In case of a shortened envelope shape, the jacket of the envelope is pushed together like a bellows, forming transversely directed folds, and shortened. The pressed bale, in turn, may protrude into the widened opening of the envelope, come into contact with the tentered bottom, and carry the bottom along during the further conveying feed, while the shortened envelope is stretched and is gradually pulled over the pressed bale along the conveying direction.

In another embodiment, the position and arrangement of the tube- and bag-like envelope is reversed, the tentered bottom being arranged in front of the rest of the jacket of the envelope and of the other open end of the envelope in the conveying direction of the pressed bale. The pressed bale comes into contact with the bottom during the conveying and carries this along during the further conveying motion, and the envelope, which is preferably arranged in a shortened form, is pulled over the moving pressed bale during its unrolling motion.

It is advantageous in these embodiments to prepare the tube- and bag-like envelope such that the bag shape is formed and to subsequently place it on the pressed bale. The envelope may be cut off here from a tube reserve as a piece of tube in the desired length and prepared for being arranged on the pressed bale. It is also opened here in a suitable form and widened such that the pressed bale can be received in the hollow interior space of the envelope.

In another variant, it is possible to form the tube-shape envelope at the preferably unmoving, but alternatively also moving pressed bale. A strip of material is wrapped here around the pressed bale to form the envelope and closed. A closed envelope jacket is formed in this case.

In the different embodiments, the tube-shape envelope has an oversize in its axial length compared to the corresponding length or extension of the pressed bale. A projection is formed at the respective axial ends of the envelope, said projection being sufficient to cover sides of the bale, which are not yet enveloped and are uncovered, especially the front and rear end faces of the pressed bale when viewed in the conveying direction and to bring closer there the axial ends or the projection thereof and to close them in a suitable manner, especially by a weld seam.

In the first variants of the tube- or bag-like envelope, the open axial end or the projection of the envelope, which projection is located there, is pulled together and closed after the pressed bale has been received. Any remnants of the envelope material can be cut off and disposed of.

In the second variant of forming the envelope at the pressed bale, both axial ends or projections can subsequently be pulled together, brought closer to, especially placed on, the uncovered side of the bale, and closed.

The bale wrapper may be shrunk onto the pressed bale and be in close contact there. This can be achieved in different ways. On the one hand, the tube-shape envelope may be formed from a stretchable material, especially a plastic film. It is first stretched to an oversize for receiving the pressed bale and it can be tightly in contact with the pressed bale received in a clampingly closed manner, while a relaxing contraction takes place. As an alternative, it is possible to use a shrinkable envelope material, which is subsequently shrunk, e.g., by heat, in a suitable manner after the bale wrapper has been placed possibly loosely on the pressed bale. For example, heat-shrinkable films or the like may be used for this purpose.

The present invention is shown in the drawings schematically and as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
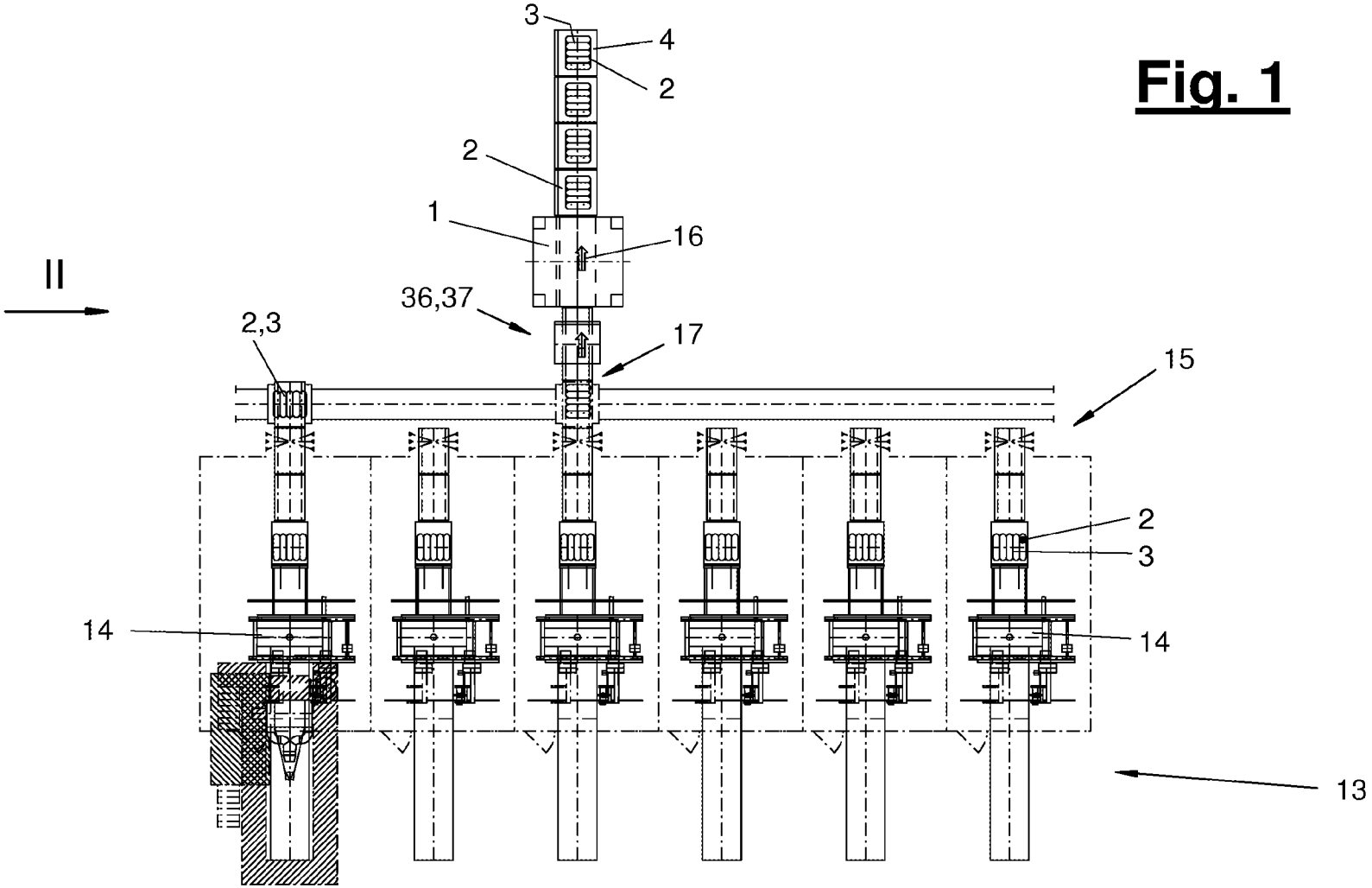
FIG. 1 is a schematic top view of a baling press plant with a plurality of baling presses and with a common packaging device in a top view.
Figure 2:
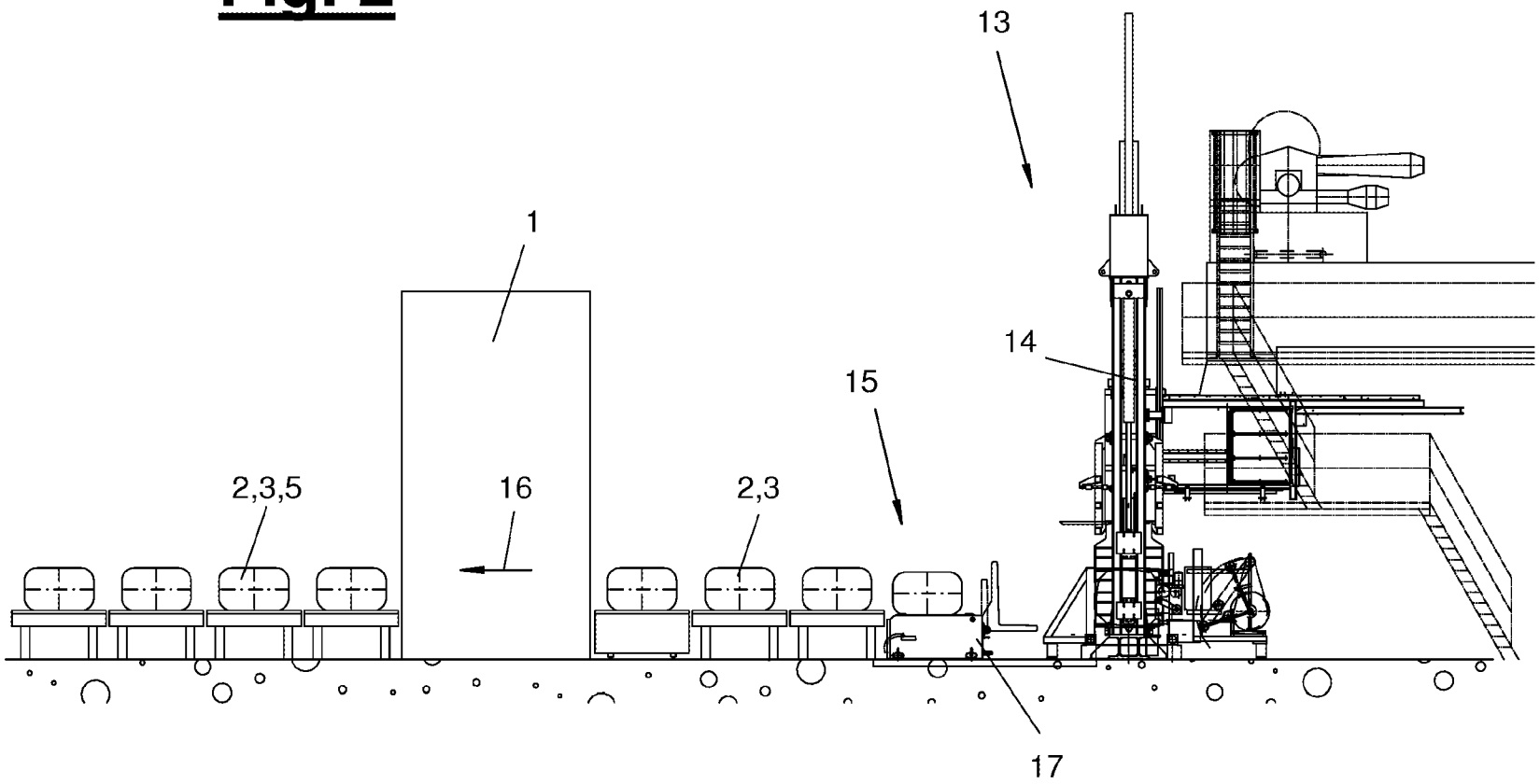
FIG. 2 is a schematic side view, according to arrow II in FIG. 1, of a baling press plant with a plurality of baling presses and with a common packaging device.

Referring to the drawings, the present invention pertains to a packaging device (1) and to a packaging process for highly compacted pressed bales (2). The present invention further pertains to a baling press (14) equipped with at least one such packaging device (1) or to a baling press plant (13) with one or more baling presses (14) and with a separate packaging device (1). The present invention also pertains to a process for producing packaged pressed bales (2) and to a use of the packaging device (1) for said highly compacted pressed bales (2).

In a schematic exemplary embodiment, FIG. 1 shows a baling press plant (13), which has a plurality of baling presses (14) lined up next to one another. Pressed bales (2) are produced and compacted in the baling presses between pressure rams under very high pressure and with pressing forces of, e.g., 300 tons to 500 tons.

Various materials may be used as the bale material. They may be, e.g., fiber materials, especially chopped synthetic fibers as so-called staple fibers or in a longer form as so-called tow. As an alternative, the bale material may consist of natural fibers, e.g., cotton or the like, in the form of staple fibers or as long fibers. Cellulose is also suitable. Further, it is also possible to use wastes, e.g., textile wastes from a tearing plant, but also other materials, preferably, small parts. These may also be plant materials.

The bale material is compacted in the baling press (14) and shaped into a pressed bale (2). The baling presses (14) may be configured for this purpose in any desired and suitable manner as a vertical press or as a horizontal press, e.g., corresponding to DE 34 32 832 A1, EP 1 120 237 A2 or WO 88/09748 A1.

The highly compacted pressed bales (2) are provided with a fixing device (3), which confers a permanent shape on them and prevents the released pressed bales (2) from expanding before the subsequent packaging. The fixing device (3) may comprise, e.g., one or more tightening straps with plastic or steel bands, which are wrapped around the pressed bale (2) during the pressing of the bale. Other fixing devices are also possible as an alternative. The fixing device (3) may optionally be arranged within the baling press (14) or on the outside with a corresponding auxiliary device.

In the embodiment shown, the baling press plant (13) has a conveying device (15) for the pressed bales (2). The baling presses (14) are connected via the conveying device (15) to a common packaging device (1). In a variant of the embodiment shown, each baling press (14) may have a packaging device (1) of its own. Further, groups of presses, to which a respective packaging device (1) each is assigned, may also be formed within the baling press plant (13). In the shown embodiment and in the above-mentioned variants, the packaging device (1) is arranged outside the one or more baling presses (14). In another variant, the packaging device (1) may also be integrated in a baling press (14), in which case the baling press (14) is configured, e.g., as a rotary press or similarly to the press disclosed in WO 88/09748 A1.

Figure 3:
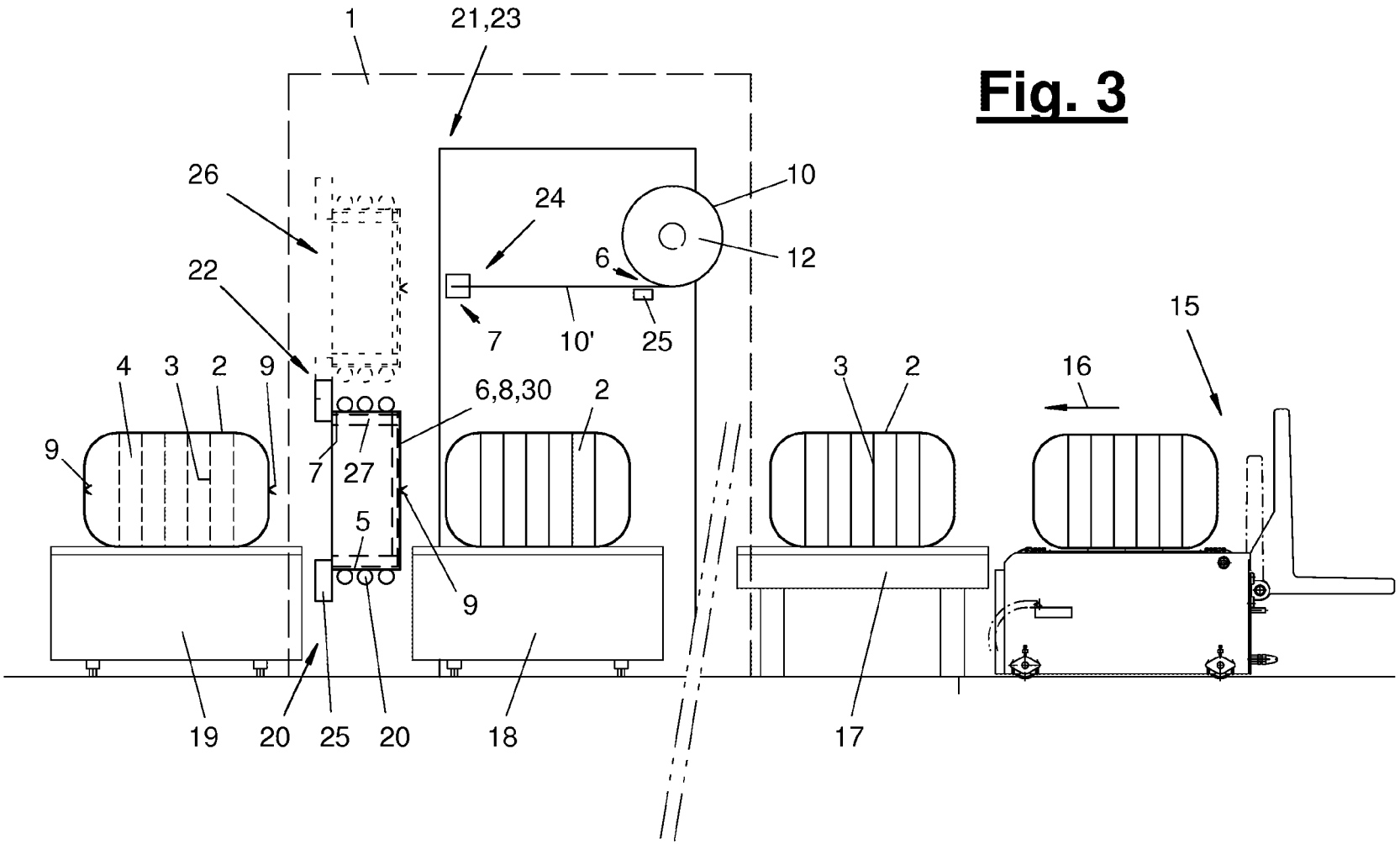
FIG. 3 is a cut-away and enlarged side view of a first variant of the packaging device according to FIGS. 1 and 2.
Figure 4:
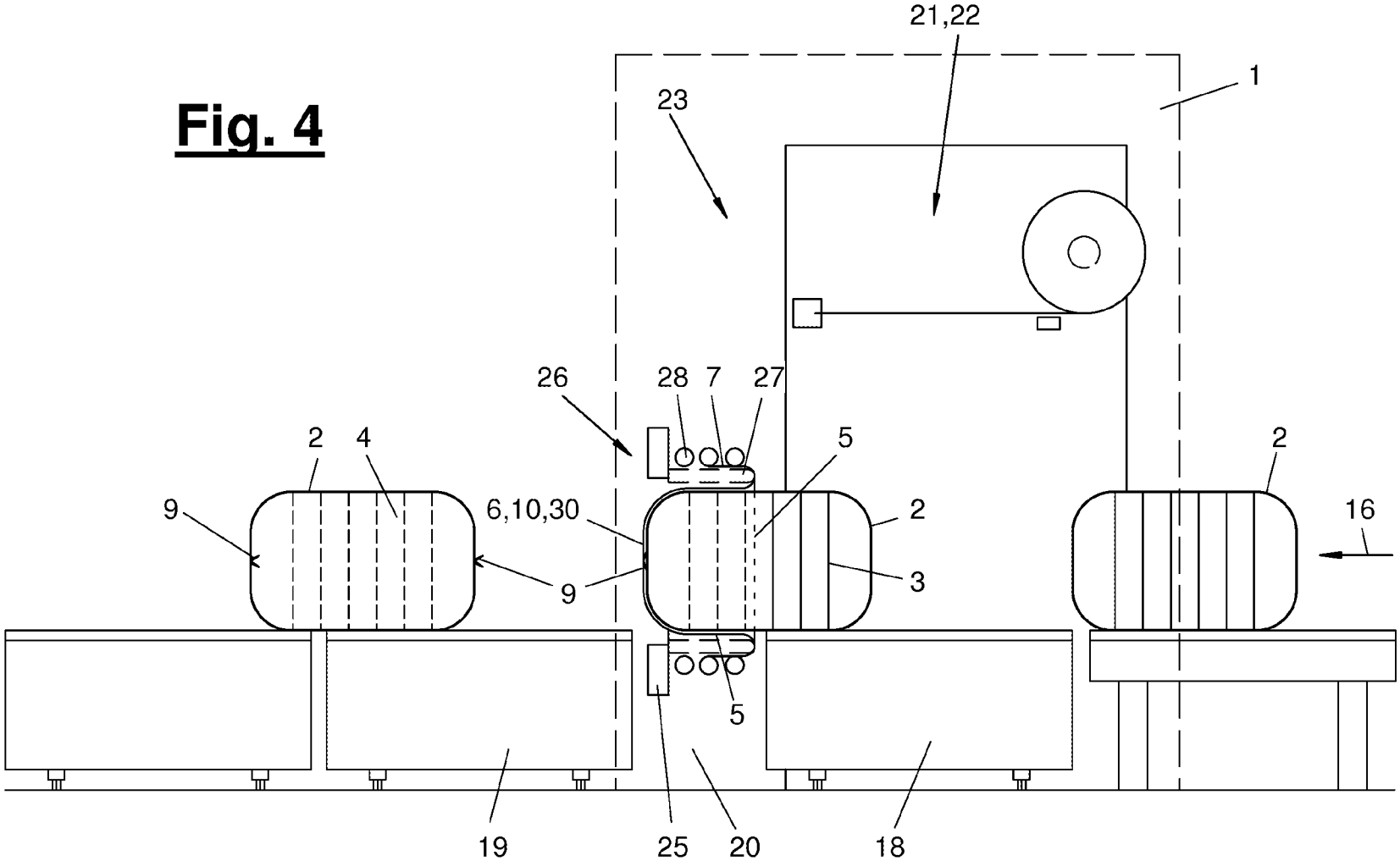
FIG. 4 is a view showing the packaging device according to FIG. 3 in one of different operating positions.
Figure 5:
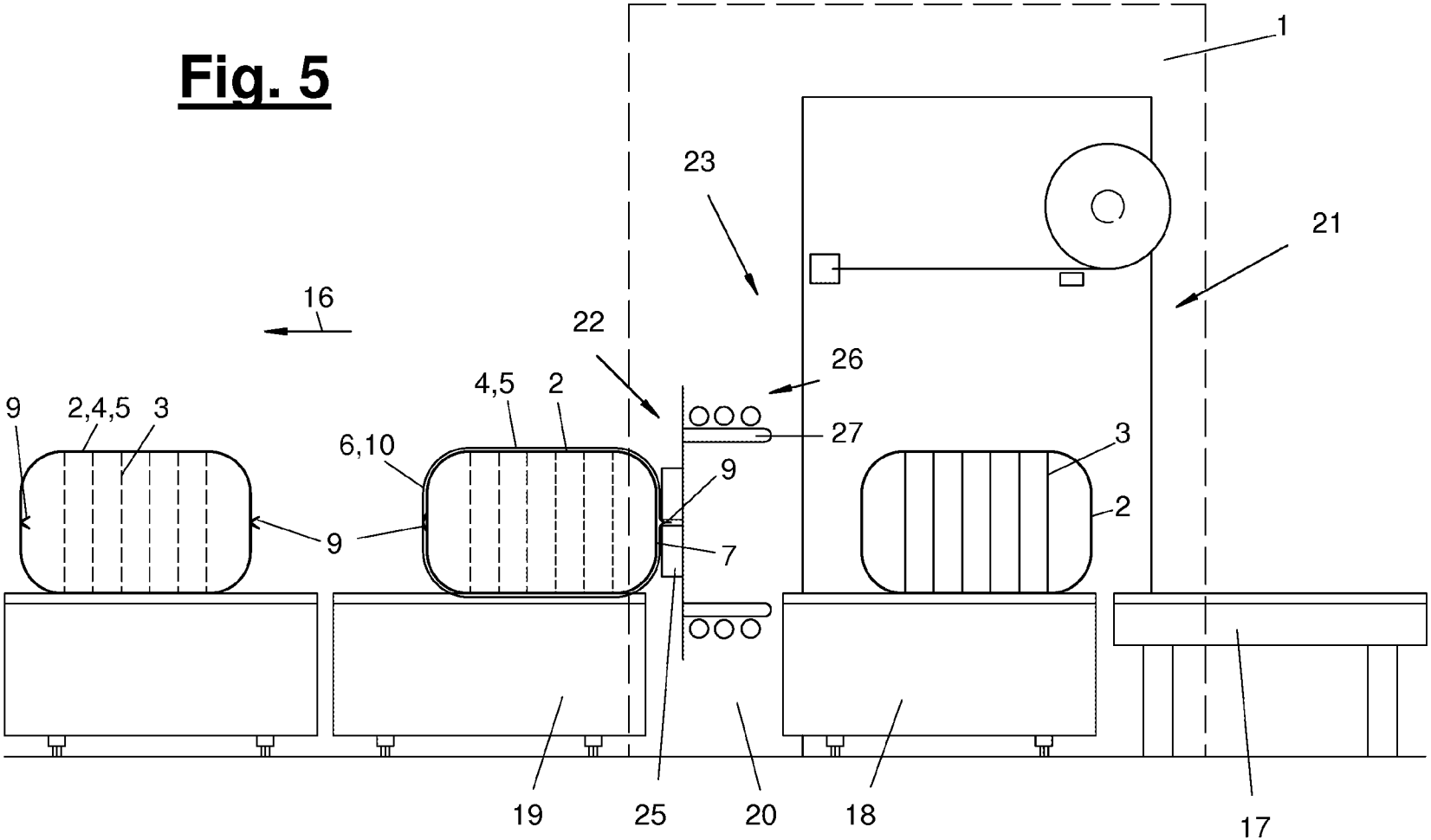
FIG. 5 is a view showing the packaging device according to FIG. 3 in another of different operating positions.

The conveying device (15) may have, according to FIG. 1, a plurality of longitudinal conveyors, which are assigned each to a respective baling press (14) and which together end at a cross conveyor. A discharge conveyor (17), on which the pressed bales (2) are fed to one or more packaging devices (1), branches off from the cross conveyor. The discharge conveyor (17) conveys the pressed bales (2) on a preferably linear and straight conveying path along a conveying direction (16). The discharge conveyor (17) may be divided into a plurality of conveying units (18, 19). An enlarged gap (20) may be present between adjacent conveying units (18, 19) in the area of the packaging device (1). FIGS. 3 through 5 show this configuration.

A monitoring device (36) for the pressed bales (2), which checks, e.g., the position and the orientation of the pressed bales (2), may be arranged at the discharge conveyor (17) and/or at another suitable location. An oblique orientation in relation to the conveying direction (16) could compromise, e.g., the packaging function. Any errors in position can be corrected by means of a stabilizing device (37). Further, the quality of the bales and the quality of the packaging can be checked in front of and behind the packaging device (1), e.g., optically by a vision system. In addition, the position and the movement of the bales in the conveying direction (16) may be monitored for control purposes.

The conveying device (15) and its conveying units (18, 19) may have different configurations. It may be in the form of track-based conveyors, which are configured, e.g., as roller tables, belt type conveyors or are configured in another suitable manner. The conveying units (18, 19) may have stationarily arranged frames. The conveying units (18, 19) may be all of the same type or of different types. A conveying unit (18, 19) may also be configured, e.g., unlike in the embodiment shown, as a floor-mounted conveying device or as a propped-up, movable conveying device, e.g., as a fork lift or in another manner.

The packaging device (1) applies a bale wrapper (4) closed on all sides on one pressed bale (2) or even on a group of a plurality of pressed bales (2). The bale wrapper (4) is preferably shrunk onto the pressed bale or pressed bales (2). This may be achieved in different ways.

With the packaging technology shown and claimed, the pressed bales (2), which are already provided with a fixing device (3), are packaged in a bale wrapper (4), which is closed on all sides. The pressed bale (2) is provided here with a tube-shape envelope (5), whose axial ends (6, 7) are brought closer to, especially placed on, the uncovered sides of the bale, and are closed with a closure (9), especially a weld seam.

The packaging device (1) has a production and application device (21) for this purpose for producing a tube-shape envelope (5) and for applying same to the pressed bale (2). Further, the packaging device (1) has a closing device (22) for bringing the tube-shape envelope (5) closer to the uncovered sides of the bale and for closing the axial ends (6, 7).

This packaging technology may be embodied in different ways in terms of configuration and the process. FIGS. 3 through 5 and FIGS. 6 through 8 show different variants for this.

The tube-shape envelope (5) has a preferably oblong axial shape in the different variants. The envelope (5) is placed preferably on the sides of the bale that are directed along the conveying direction (16), especially the long sides of the pressed bale (2). The envelope jacket now encloses the sides of the bale and accommodates them in the hollow interior space. The sides of the bale that are directed crosswise (at oblique or right angles) to the conveying direction (16), especially the front and rear end faces of the pressed bale (2), remain at first uncovered. The tube-shape envelope (5) may likewise be directed in the conveying direction (16).

The envelope (5) preferably has an oversize in its axial length relative to the corresponding direction, especially the length, of the pressed bale (2). The tube-shape envelope (5) has axial ends (6, 7). A projection is formed at these ends due to the oversize. This projection is brought closer with the closing device (22) to the adjacent uncovered side of the bale and is preferably placed on same, and closed.

The tube-shape envelope (5) is produced with the production and application device (21) and placed on the pressed bale (2).

In the one variant shown in FIGS. 3 through 5, the tube-shape or tubular envelope is widened such that it can accommodate the pressed bale (2) in its interior space. A widened, tube- and bag-like envelope (5), which is closed on one side, is pulled over the pressed bale (2) in this variant. One axial end (6) of this envelope (5) was closed in advance, forming a tentered front wall (8) directed crosswise (at oblique or right angles) to the bale conveying direction (16). After receiving the pressed bale (2) in the tube-shape envelope (5), the other projecting axial end (7) of this envelope (5) is brought closer to, especially placed on, the uncovered and preferably rear side of the bale, and is closed with a closure (9), especially a weld seam. Due to the one axial end (6) and its projection being closed, the tube-shape envelope (5) and its projection assume a bag-like shape, and the axial end (6) or the front wall (8) tentered hereby forms the bottom (30) of the bag. The other axial end (7) remains at first open during the insertion of the bale and forms the opening (29) of the bag.

In one embodiment of this variant, the pressed bale (2) can be inserted into the open axial end (7) or the opening (29) and it then comes into contact with the previously closed axial end (6) or the bottom (30) or the front wall (8) tentered by the widening of the envelope (5). The envelope (5) is widened by means of a stretching device (26) such that the entering pressed bale (2) can carry along the front wall (8) as well as the stretched or shortened jacket of the tube- or bag-like envelope (5) during its conveying motion and pull it off from the stretching device (26) in the process. The envelope (5) is now pulled over said long sides of the pressed bale (2). A braking device or the like at the stretching device (26) can keep a shortened envelope (5) tight and prevent a premature sliding off, so that the envelope (5) is pulled completely over the longitudinal extension of the pressed bale (2) and projects over the rear side of the pressed bale with the open axial end (7). The pressed bale (2) first enters the open end (7) or the opening (29) of the envelope (5) in this embodiment and it reaches the closed end (6) or the front wall (8) or the bottom (30) only thereafter.

In another variant of the first variant, shown in FIGS. 3 through 5, the pressed bale (2) is first moved towards the tentered front wall (8) and it carries same with it, and the possibly shortened tube- and bag-like envelope (5) is unrolled over the moving pressed bale (2) during its conveying. The envelope (5) is pulled over here by an unrolling motion at the stretching device (26). The unrolling ensures the correct pulling-off of the envelope and can do without the aforementioned braking device.

The tube-shape envelope (5) may be a finished part or it may have been prepared and produced in both embodiments. During the production shown, the envelope (5) is first cut to the desired length and is received by said stretching device (26) in the stretched or shortened form and is widened. It is then kept ready for receiving the pressed bale (2) over the conveying path thereof and is positioned. This may happen in said gap (20).

The production and application device (21) has a pull-over device (23) for the tube- and bag-like envelope (5) in the first variant and in said embodiments. This pull-over device is configured for carrying out the aforementioned function. The packaging device (1), especially the pull-over device (23), has a displaceable, especially movable and/or pivotable stretching device (26), which receives the tube-shape envelope (5), which was preferably cut to the desired length, in the stretched or shortened as well as widened form and keeps it ready and positions it in the conveying path of the pressed bale.

The pull-over device (23) has, according to FIG. 3, a material reserve (12) for a tube (10), from which the envelope (5) is formed. The material reserve (12) may be, e.g., the coil shown, which is oriented above the pressed bale (2) and in a lying, especially horizontal orientation at right angles to the conveying direction (16). As an alternative, the material reserve (12) may be arranged under the pressed bales (2) and the conveying path. In another variant, it may assume an upright and standing position and be arranged on the side next to the conveying path and the pressed bales (2).

A piece of tube (10') corresponding to the desired length of the envelope is pulled off from the material reserve (12) with a pull-off device (24) and is cut off from the material reserve (12) by means of a cutting and welding device (25). The front end of the piece of tube (10') forms the open axial end (7) of the envelope (5) or the bag opening (29). The cut-off as well as closed, especially welded rear end of the piece of tube (10') forms the rear axial end or the bottom (30).

The stretching device (26) has a stretching frame (27), which can be moved between a receiving position for taking over the piece of tube (10') provided and the application position at the gap (20). In the embodiment shown in FIGS. 3 through 5, this is a vertical motion. It may have a correspondingly direct orientation in case of a different orientation of the coil. The stretching frame (27) receives the widened piece of tube (10') or the envelope (5) formed thereby. It has, e.g., four holding arms for this purpose, over which the envelope (5) with the open end (7) or with the opening (29) in the front can be pulled or pushed. The holding arms are oriented along the conveying direction (16) and are distributed prismatically, especially in a rectangle, such that the envelope (5) can be widened and tentered for receiving the bale.

A finger arrangement, not shown, which grips the tube edges, which lie at first tightly on one another, at the front end (6), and pulls them apart by a transverse motion such that the needed widening of the envelope will take place and the transfer to the stretching frame (27) standing by is possible, may be present for widening the piece of tube (10') or the envelope (5) and for the transfer to the stretching frame (27).

A shortening device (28), which pulls the envelope (5) transferred with the open axial end (7) in the front over the outer jacket of the stretching frame (27) and over the holding arms thereof and pushes it together in the manner of a bag, forming transversely directed folds, may be arranged at the stretching frame (27). The shortening device (28) may have any desired and suitable configuration. It may be formed, e.g., by controllably driven shortening rollers, which are arranged as individual rollers or as a plurality of rollers at the holding arms.

The envelope jacket is pulled over the stretching frame (27) during this receiving to the extent that the closed axial end (6) or the front wall (8) tentered by the widening or the bottom (30) comes into contact with the stretching frame (27) on the front side. When viewed in the conveying direction (16), the front wall (8) is located in front of the rest of the envelope jacket and the open end (7).

A closure (9), especially a weld seam, is formed by the aforementioned cutting off and closure, especially welding, of the one axial end (6). The cutting and welding device (25) mentioned may be a part of the closing device (22).

FIG. 3 shows the aforementioned take-over position of the stretching frame (27) by broken lines. The stretching frame (27) is then moved into the conveying path and into the gap (20), wherein the front wall or the bottom (30) is directed crosswise (at oblique or right angles) to the arriving pressed bale (2) and is carried by same during the conveying motion. FIGS. 4 and 5 show the further steps during the pulling of the envelope (5) over the pressed bale (2) and the unrolling of the envelope (5), which now takes place.

The pressed bale (2) is moved through the stretching frame (27). The envelope (5) received on the outer side of the frame is now pulled over the front side of the stretching frame (27), which front side has a configuration favorable for the unrolling, and over the holding arms thereof and is turned by about 180° in the process. For example, round ropes may be stretched as a rolling edge between the holding arms. The rolling motion may be supported by the shortening device (28), which conveys the envelope jacket in a controlled manner to the front side of the stretching frame (27).

When the pressed bale (2) is received in the tube- and bag-like envelope (5) according to FIG. 5, the projecting rear axial end (7) can be pulled together by a cutting and welding device (25) and welded to form a closure (9). It is brought in the process closer to the rear end face of the pressed bale (2) and is placed preferably tightly over it.

The cutting and welding device (25) may be arranged at the stretching device (26), especially at the stretching frame (27). As an alternative, it may be arranged independently and be able to be displaced, especially moved and/or pivoted, in a suitable manner.

The stretching frame (27) freed from the envelope (5) can subsequently be moved again upward or in another direction to the material reserve (12) to receive the next cut-off piece of tube (10). The above-described cycle will then begin anew.

Figure 6:
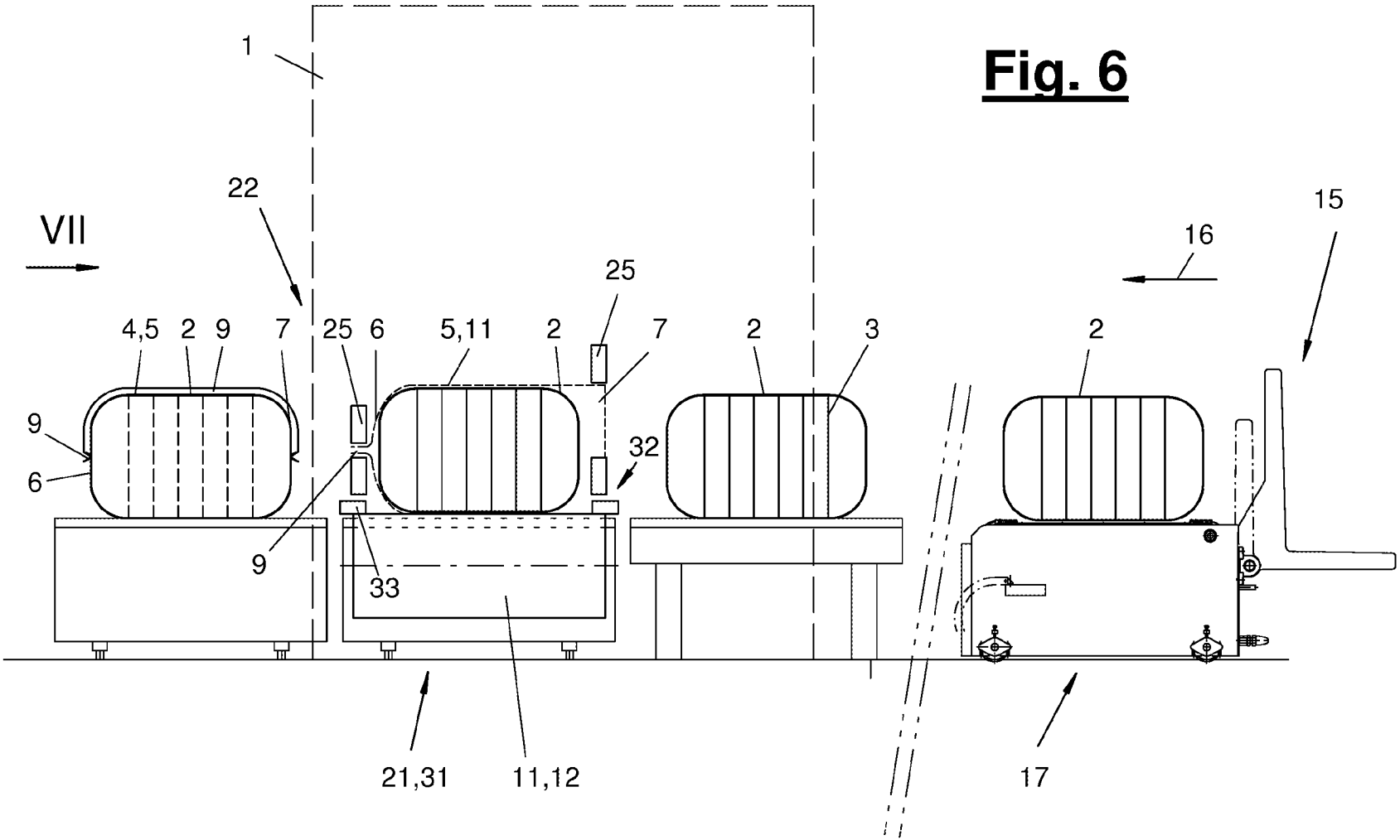
FIG. 6 is a side view showing a second variant of the packaging device.
Figure 7:
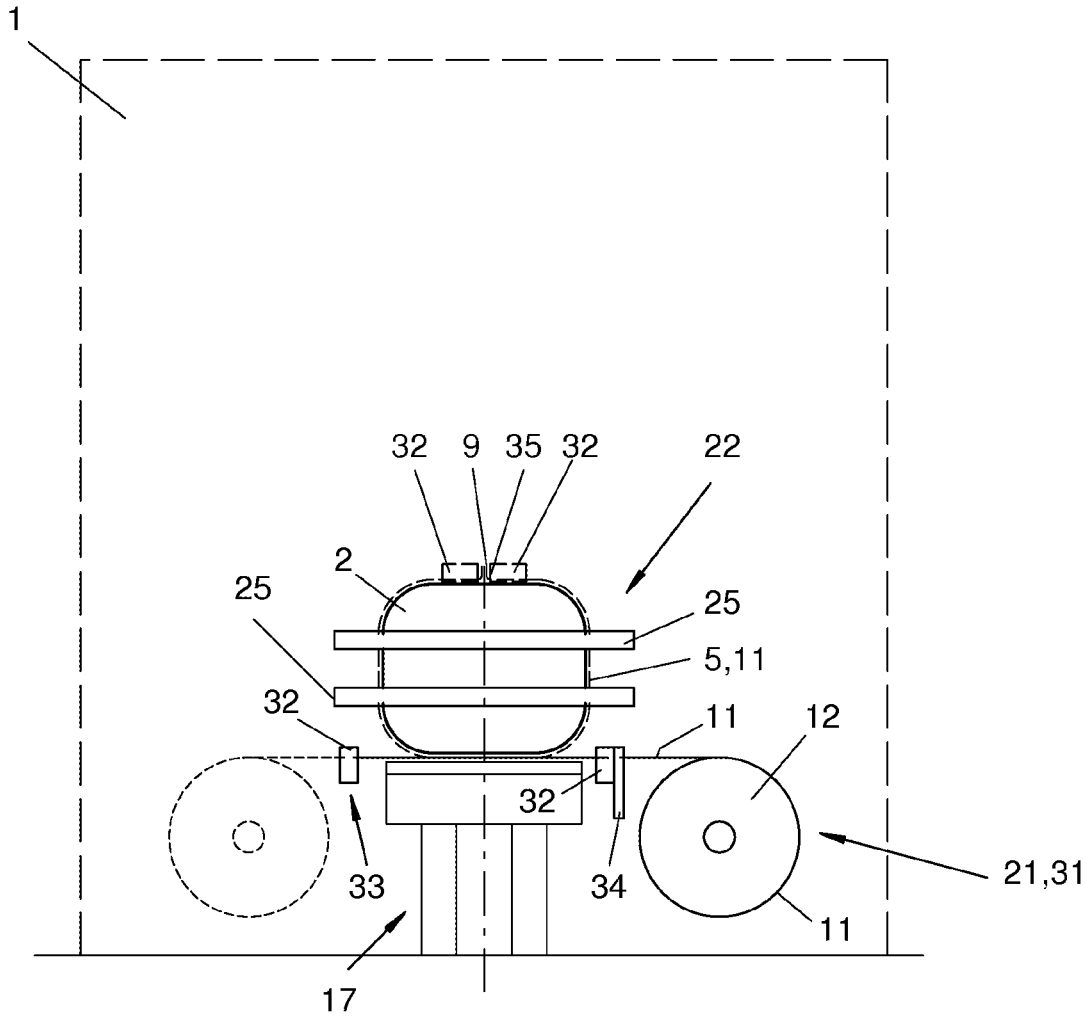
FIG. 7 is a front view showing a variant according to arrow VII in FIG. 6.
Figure 8:
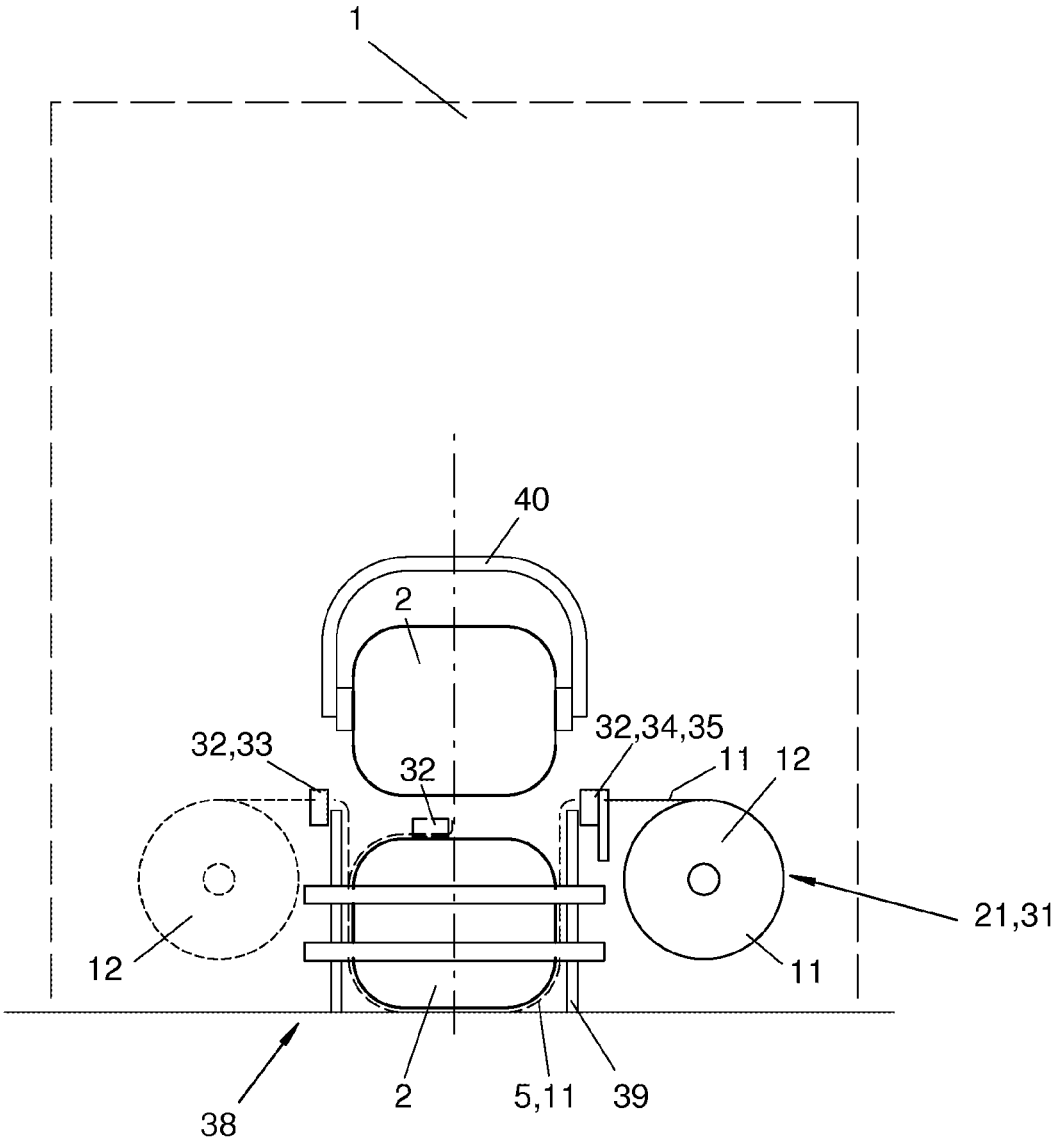
FIG. 8 is a front view showing another variant of the packaging device.

The second variant of the packaging technology and of the production and application device (21) as well as of the closing device (22) is shown in FIGS. 6, 7 and 8. FIGS. 7 and 8 show variants of FIG. 6.

The tube-shape envelope (5) is formed at the pressed bale (2) in the second variant by throwing over and closing a strip of material (11). The strip of material (11) may also be present as a plurality of strips of material. The wrapping motion may be directed at right angles to the conveying direction (16). The production and application device (21) has a wrapping device (31), which is configured for carrying out the above-mentioned function.

The wrapping device (31) has in FIGS. 6 through 8 at least one material reserve (12), e.g., the coil shown, from which an, e.g., sheet-like or film-like, especially single-layer strip of material (11) can be pulled off and placed according to FIGS. 6 and 7 on the discharge conveyor (17). The next arriving pressed bale (2) can then be pushed during its conveying motion onto the strip of material (11), so that the underside of the bale is covered by the strip of material. The strip of material (11) has an excess length on both sides relative to the extension to be wrapped in, especially the long sides, of the pressed bale (2). The material reserve (12) may be arranged laterally next to the conveying path of the pressed bale (2), and a piece of the strip of material (11) is pulled over the discharge conveyor (17) at right angles to the conveying direction (16) in the embodiment shown by solid lines in FIGS. 6 and 7.

The wrapping device (31) may have a pull-off device (33), with which a free end of the strip of material (11), which end is kept ready, is gripped at the material reserve (12) and pulled in the manner mentioned at right angles over the discharge conveyor (17). Further, a cutting device (34) may be present, with which the pulled-off piece of strip is cut off from the reserve in the desired length and the reserve-side end is held ready for being gripped.

The wrapping device (31) further has one or more wrapping units (32), which grip the lateral ends of the strip of material (11), which ends extend along the conveying direction (16), in order to pull them around the pressed bale (2) standing by and to connect them to one another and to close them. An axial closure (9), especially a weld seam, can be formed hereby. The wrapping units (32) may be formed, e.g., by clamping jaws, which can carry out a suitable wrapping motion with a corresponding drive technology. One or more welding devices (35), which connect the ends of the strip while forming a closure (9), especially a weld seam, may be arranged at the wrapping units (32), which are preferably arranged on both sides of the pressed bale (2). A circumferentially closed envelope (5) is formed on the pressed bale (2) in this manner.

The axially projecting ends (6, 7) can then be brought by the closing device (22) closer to, especially placed on, the free and uncovered sides of the pressed bale, especially the front and rear sides oriented crosswise (at oblique or right angles) to the conveying direction (16), and closed. The closing device (22) may have two cutting and welding devices (25) for this purpose at said sides of the bale.

The cutting and welding device (25) may have, e.g., a bar-like configuration in the different variants. As an alternative, they may be formed from gripping arms or in another suitable manner.

FIG. 7 shows a first variant of the second variant by broken lines. Two strip reserves (12), especially coils, are arranged here on both sides of the discharge conveyor (17) and they clamp between them said strip of material (11) at right angles above the discharge conveyor (17). The cutting device (34) may be arranged at the wrapping units (32) in this case. The wrapping units (32), which are arranged on both sides of the pressed bale (2), just like in the first embodiment, grip the tentered strip of material (11) from below and pull material strip around the pressed bale (2) from the material reserves (12) during their wrapping motion. On the top side or at another suitable location of the pressed bale (2), the wrapping units (32) move the strip areas received towards one another and connect them to one another, and at the same time they are cut off from the strip sections leading to the material reserves (12). These strip sections are, in turn, connected to one another. After removal of the wrapped pressed bale (2), said connected strip sections can be tightened and placed again on the discharge conveyor (17) as well as made available for the next pressed bale (2).

The wrapping device (31) does not have to be arranged at the discharge conveyor (17). It may be arranged at a stationary or mobile intermediate storage device. FIG. 8 shows such a second variant.

The intermediate storage device (38) may have, e.g., a bale pick-up (39), into which a pressed bale (2) provided with a fixing device (3) is inserted by means of a suitable conveyor (40), e.g., an overhead conveyor with a gripper. This can be carried out from the top. The bale pick-up (39) may have, e.g., a trough-like or box-like shape. It may also be formed by two or more opposite, upright guide walls or guide strips.

The strip of material (11) can be pulled off from at least one material reserve (12) via the access opening of the ball pick-up (39) and tentered. Two coils are shown in FIG. 8. On insertion into the ball pick-up (39), the bale (2) carries with it the strip of material (11), which is pulled off from the material reserve (12) as a result and is placed around the pressed bale (2) in a U-shaped form. At the same time or later, it is thrown by the wrapping units (32) over the upper and lower parts of the pressed bale (2) and cut off by means of the cutting device (34) as well as welded by a welding unit (35) or the like to form the closure. The closure (9) may also be formed in another manner. FIG. 8 shows the inserted state in its right-hand part and the wrapped state with the wrapping units (32) in its left-hand part.

After forming the tube-shape envelope (5) at the pressed bale (2), the ends of said envelope, which project on the front side thereof, can be brought closer to, especially placed on, the respective uncovered side of the bale in the above-described manner and welded, e.g., with a welding device (25) and closed. As an alternative, other methods and devices are also possible here for forming the closure or closures (9).

The packaged pressed bale (2) can then be removed in a suitable manner, e.g., by means of a floor-side conveyor (not shown). As in FIGS. 6 and 7, the one wrapping unit (32) can grip the cut-free end of the strip when forming the closure (9) and pull it over the insertion opening or form again a closed strip of material (11) between the material reserves (12) located on both sides.

In one variant, not shown, the intermediate storage device (38) may be formed by a possibly stationary table or base, which has a support function similar to that of the discharge conveyor (17) in the embodiment according to FIG. 6 and is placed over the one strip of material (11). A conveyor (40) can deposit in a suitable manner a pressed bale (2), which has, e.g., been gripped, on the table-like intermediate storage device (38) and on the strip of material (11) and remove it again after placing the tube-shape envelope (5) or the bale wrapper (4). In a variant of FIG. 6, such an additional conveyor (40) can also place a pressed bale (2) on the beginning and receiving area of a belt or track-based conveyor or roller table or the like and place it over the strip of material (11) available there.

The bale wrapper (4) is shrunk on the pressed bale (2) in the different variants. This may be carried out in different ways. On the one hand, the envelope (5) may consist of a material having elongation elasticity, which can again shrink elastically itself after a stretching. The material may be, e.g., a plastic having elongation elasticity, especially a polyethylene. Especially favorable are plastic films made of a long-chain low-density polyethylene, especially LLDPE. The envelope (5) may have a smaller cross-sectional dimension in the initial state than the pressed bale (2), in which case it is stretched to an oversize by the stretching device (26) to receive the bale and will again undergo a relaxing contraction when it is pulled off and placed on the pressed bale (2). Such a configuration is possible in both variants.

As an alternative, the envelope (5) may consist of a material shrinkable in another manner, which contracts, e.g., under the action of heat and shrinks onto the pressed bale (2). The envelope (5) may have an oversize in terms of its inner transverse dimension relative to the pressed bale (2). It also does not need to have elongation elasticity.

Different variants of the embodiments shown and described are possible. The closing of the axial ends (6, 7) or of the strip ends or strip sections may be carried out in the variants in a different manner than by welding, e.g., by sewing, clamping, bonding or the like. Said cutting and welding devices are correspondingly defined in their general form as cutting and closing devices.

In a variant of the second variant, the envelope (5) may be formed at the moving pressed bale (2), in which case the wrapping device (31) is moved along synchronously with the bale feed.

In the first variant with the stretching device (26), the pressed bale (2) may be temporarily supported by a support element (not shown) in the area of the gap. This may be, e.g., a support device at the stretching frame (27). As an alternative, a support element of one of the conveying units (18, 19) may be temporarily extended in the conveying direction (16).

In another embodiment, not shown, a tube-shape envelope (5) with axial ends (6, 7) open on both sides may be provided, and the pressed bale (2) is pushed in a suitable manner into the correspondingly widened envelope (5), e.g., by means of a slide or the like. Both axially projecting ends (6, 7) can subsequently be brought closer to, especially placed on, the uncovered sides of the bale in the above-described manner, and closed, especially welded.

While specific embodiments of the invention have been shown and described in detail to illustrate the application of the principles of the invention, it will be understood that the invention may be embodied otherwise without departing from such principles.

The invention claimed is:

1. A process for producing packaged pressed bales of fibers, the process comprising the steps of:

compacting fibers in a baling press between pressure rams under pressure to produce a compacted pressed bale;

providing the pressed bale with a fixing element comprising one or more tightening straps made of plastic or steel bands, wherein the fixing element is wrapped around the pressed bale during the producing of the compacted pressed bale;

providing a packaging device comprising a shortening device cooperating with a stretching device, the packaging device being arranged outside the baling press;

providing a conveying device equipped with conveying units and configured to convey pressed bales in a bale conveying direction from the baling press to the packaging device and with a gap between adjacent conveying units in an area of the packaging device;

feeding, with the conveying device, the pressed bale, that has been provided with the fixing element, from the baling press to the packaging device;

with the packaging device, packaging the pressed bale, that has been provided with the fixing element, in a bale wrapper to provide a packaged pressed bale that has the bale wrapper closed on all sides of the bale, wherein the packaged pressed bale is packaged by;

providing a tube-shape envelope;

cutting the tube-shape envelope to a length such that the tube-shape envelope is provided with axial ends;

shortening the tube-shape envelope to a non-extended state with the shortening device;

receiving the tube-shape envelope by the stretching device in the non-extended state, the stretching device having a stretching frame with a front bale entry side;

closing one of the axial ends of the tube-shape envelope before the widening;

widening the tube-shape envelope with the stretching device, wherein the widening forms a tentered front wall comprising the closed one axial end at the front bale entry side;

moving the stretching device, with the received tube-shape envelope, into the gap between adjacent conveying units such that the tentered front wall is oriented crosswise to the bale conveying direction;

maintaining the stretching device in the gap such that the tube-shape envelope positioned with the tentered front wall oriented crosswise to the bale conveying direction is positioned for receiving the pressed bale along a conveying path thereof;

moving the pressed bale by the conveying device against the tentered front wall of the widened tube-shape envelope with the pressed bale carrying the tentered front wall along with the moving pressed bale to extend, with an unrolling motion, the tube-shape envelope over the moving pressed bale during the conveying thereof and pulling the tube-shape envelope, with the unrolling motion, over the pressed bale from the non-extended state to an unrolled state during the conveying thereof in the bale conveying direction, wherein the unrolling motion is supported by the shortening device, which controls a conveyance, via the unrolling motion, of a jacket of the tube-shape envelope to the front bale entry side of the stretching frame;

bringing a projecting end, formed by an open axial end of the tube-shape envelope, closer to the uncovered side of the bale after the pressed bale has been received in the tube-shape envelope; and welding the projecting end at the stretching device to form a closure configured as a weld seam to provide the packaged pressed bale that is closed on all sides.

2. The process in accordance with claim 1, wherein the tube-shape envelope is formed from a stretchable material and is at first stretched, with the widening, to an oversize for receiving the pressed bale and is then placed on the received pressed bale under relaxing contraction.

3. A baling press plant comprising:

at least one baling press for producing a compacted pressed bale of fibers;

a fixing device at the baling press configured to apply a fixing element on the pressed bale during the producing of the pressed bale, the fixing element comprising one or more tightening straps made of plastic or steel bands;

a packaging device for placing a bale wrapper, that is closed on all sides of the bale, on the pressed bale with the applied fixing element, the packaging device being located outside the baling press;

a conveying device comprising conveying units, the conveying units being configured to convey pressed bales from the baling press to the packaging device in a bale conveying direction, wherein a gap, present between adjacent conveying units, is in an area of the packaging device, the packaging device comprising:

a production and application device for preparing a tube-shape envelope, having axial ends, to provide as the bale wrapper;

a closing device configured to close one of the axial ends of the tube-shape envelope to provide the tube-shape envelope with a closed axial end;

a stretching device having a stretching frame with a front bale entry side, the stretching device being configured to widen the tube shaped envelope and tenter a front wall of the tube-shape envelope at the closed axial end, wherein the tentered front wall is oriented crosswise to the bale conveying direction and positioned at the front bale entry side, wherein the stretching device is further configured to maintain the tube-shape envelope ready and positioned for receiving the pressed bale, the stretching device being moveable into and out of the gap present between adjacent conveying units; and a shortening device configured to position the tube-shape envelope in a non-extended state, which is received at the stretching device, to provide the tube-shape envelope in the non-extended state, wherein the stretching device and shortening device are configured such that the pressed bale carries the tentered front wall along with the moving pressed bale to extend, with an unrolling motion, the tube-shape envelope over the moving pressed bale during the conveying thereof and pull the tube-shape envelope, with the unrolling motion, over the pressed bale from the non-extended state to an unrolled form during the conveying thereof in the bale conveying direction, wherein the unrolling motion is supported by the shortening device, which controls a conveyance, via the unrolling motion, of a jacket of the tube-shape envelope to the front bale entry side of the stretching frame, wherein the closing device is configured to move the other of the axial ends of the tube shaped envelope towards uncovered sides of the bale and for closing the other of the axial ends of the tube-shape envelope.

4. The baling press plant in accordance with claim 3, wherein the stretching frame of the packaging device with a tube-shape envelope received is inserted into the gap, in a conveying path along the bale conveying direction of the pressed bale and is removed therefrom after placing the bale wrapper, that is closed on all sides of the bale, on the pressed bale with the applied fixing element.

5. The baling press plant in accordance with claim 3, wherein the closing device comprises one or more closing elements configured to close said one of the axial ends of the tube-shape envelope to provide the tube-shape envelope with the closed axial end and one or more different closing elements configured to move said other of the axial ends of the tube shaped envelope towards the uncovered sides of the bale and for closing the other of the axial ends of the tube-shape envelope.

6. A baling press plant comprising:

at least one baling press for producing a compacted pressed bale of fibers;

a fixing device at the baling press configured to apply a fixing element on the pressed bale during the producing of the pressed bale, the fixing element comprising one or more tightening straps made of plastic or steel bands;

a packaging device for placing a bale wrapper, that is closed on all sides, on the pressed bale with the applied fixing element; and a conveying device comprising conveying units, the conveying units being configured to convey pressed bales from the baling press to the packaging device, in a bale conveying direction, wherein a gap, present between adjacent conveying units, is in an area of the packaging device, the packaging device comprising:

a production and application device for preparing a tube-shape envelope, having axial ends, to provide as the bale wrapper;

a closing device configured to close one of the axial ends of the tube-shape envelope to provide the tube-shape envelope with a closed axial end;

a stretching device having a stretching frame with a front bale entry side, the stretching device configured for widening the tube shaped envelope to form a tentered front wall of the tube-shape envelope comprising the closed axial end at the front bale entry side, wherein the stretching frame is configured to be movable between a receiving position, for receiving the tube shaped envelope, and an application position for applying the tube shaped envelope to the pressed bale, the application position being in the gap between adjacent conveying units such that the stretching device receives the pressed bale along a conveying path in the bale conveying direction thereof, and maintains the tube-shape envelope ready and positioned for receiving the pressed bale, wherein the gap is configured to fit the stretching frame; and a shortening device configured for shortening the tube-shape envelope received at the stretching device to provide the tube-shape envelope in a shortened form, wherein the stretching device and shortening device are configured such that the pressed bale carries the tentered front wall along with the moving pressed bale to extend, with an unrolling motion, the tube-shape envelope over the moving pressed bale during the conveying thereof and pull the tube-shape envelope, with the unrolling motion, over the pressed bale from the shortened form to an unrolled form during the conveying thereof in the bale conveying direction, wherein the unrolling motion is supported by the shortening device, which controls a conveyance, via the unrolling motion, of a jacket of the tube-shape envelope to the front bale entry side of the stretching frame, wherein:

the closing device is configured to move the other of the axial ends of the tube shaped envelope towards uncovered sides of the bale and for closing the other of the axial ends of the tube-shape envelope.

7. The baling press plant in accordance with claim 6, wherein the production and application device includes a roll of envelope material for feeding tube-shape envelope material to the stretching device at the receiving position, wherein the stretching device moves to the receiving position to receive the tube-shape envelope, which is fed onto the stretching frame of the stretching device from the roll of envelope material of the production and application device and the roll of envelope material is cut by the closing device at the receiving position and the stretching device is moved, with the cut envelope material on the stretching frame to the application position.

8. The baling press plant in accordance with claim 6, wherein the closing device comprises one or more closing elements configured to close said one of the axial ends of the tube-shape envelope to provide the tube-shape envelope with the closed axial end and one or more different closing elements configured to move said other of the axial ends of the tube shaped envelope towards the uncovered sides of the bale and for closing the other of the axial ends of the tube-shape envelope.

* * * * *